US012624423B2

(12) United States Patent
Guo et al.

(10) Patent No.: US 12,624,423 B2
(45) Date of Patent: May 12, 2026

(54) ALUMINUM ALLOY AND PREPARATION METHOD THEREOF, AND ALUMINUM ALLOY STRUCTURAL MEMBER

(71) Applicant: BYD COMPANY LIMITED, Guangdong (CN)

(72) Inventors: Qiang Guo, Shenzhen (CN); Mengmeng Cao, Shenzhen (CN); Quanyu Gong, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 844 days.

(21) Appl. No.: 17/789,111

(22) PCT Filed: Mar. 26, 2020

(86) PCT No.: PCT/CN2020/081382
§ 371 (c)(1),
(2) Date: Jun. 24, 2022

(87) PCT Pub. No.: WO2021/128619
PCT Pub. Date: Jul. 1, 2021

(65) Prior Publication Data

US 2023/0062077 A1 Mar. 2, 2023

(30) Foreign Application Priority Data

Dec. 26, 2019 (CN) ..... 201911370452.8

(51) Int. Cl.
*C22C 21/10* (2006.01)
*B22D 21/04* (2006.01)
*C22C 1/02* (2006.01)

(52) U.S. Cl.
CPC ..... *C22C 21/10* (2013.01); *B22D 21/04* (2013.01); *C22C 1/026* (2013.01)

(58) Field of Classification Search
CPC ..... C22C 21/10; C22C 1/026; C22C 1/03; B22D 21/04; B22D 17/00
See application file for complete search history.

(56) References Cited

FOREIGN PATENT DOCUMENTS

| | | | | |
|---|---|---|---|---|
| CN | 1489637 | A | | 4/2004 |
| CN | 102002615 | A | | 4/2011 |
| CN | 103031473 | A | | 4/2013 |
| CN | 105088033 | A | | 11/2015 |
| CN | 105779829 | A | | 7/2016 |
| CN | 106167868 | A | | 11/2016 |
| CN | 107406925 | A | | 11/2017 |
| CN | 108300910 | A | * | 7/2018 |
| CN | 109252077 | A | | 1/2019 |
| CN | 110106408 | A | | 8/2019 |
| CN | 110157959 | A | | 8/2019 |
| JP | H05179384 | A | | 7/1993 |
| KR | 20160139138 | A | | 12/2016 |

OTHER PUBLICATIONS

CN108300910A: Espacenet English machine translation (Year: 2018).*
English Translation of International Search Report from PCT/CN2020/081382 dated Sep. 25, 2020 (2 pages).

* cited by examiner

*Primary Examiner* — Adil A. Siddiqui
(74) *Attorney, Agent, or Firm* — Calfee, Halter & Griswold LLP

(57) ABSTRACT

An aluminum alloy is provided. Based on the total weight of the aluminum alloy, in percentage by weight, the aluminum alloy includes: 11-15% of Zn; 7.5-9% of Si; 1.2-2% of Cu; 0.3-0.5% of Mn; 0.05-0.3% of Mg; 0.1-0.2% of Ni; 0.001-0.04% of Sr; 0.05-0.3% of Ti; 0.01-0.15% of Fe; and 72.51-79.79% of Al.

20 Claims, No Drawings

ALUMINUM ALLOY AND PREPARATION METHOD THEREOF, AND ALUMINUM ALLOY STRUCTURAL MEMBER

CROSS-REFERENCE TO RELATED APPLICATIONS

The present disclosure is the National Stage of the PCT International Application No. PCT/CN2020/081382, filed on Mar. 26, 2020, which claims priority to and benefit of Chinese Patent Application Serial No. 201911370452.8 filed with the China National Intellectual Property Administration on Dec. 26, 2019. The entire content of the above-referenced applications is are incorporated herein by reference.

FIELD

The present disclosure relates to the technical field of materials, and particularly relates to an aluminum alloy and a method for preparing the same, and an aluminum alloy structural member.

BACKGROUND

Die casting, one of the basic forming methods for aluminum alloys, can be used for designing intricate structural member products. The most commonly used die casting aluminum alloy is ADC12, an Ai-Si—Cu alloy for die casting according to Japanese Industrial Standard JIS H5302. This material is good in fluidity and formability, large in molding window and high in cost performance, and has been widely used in aluminum alloy die casting products. ADC12 has the advantages of low density, high strength-to-weight ratio, etc., and can be used for casings, small-sized thin products, holders or the like. However, the die casting products of ADC12 are medium in strength, with a tensile strength of 230-250 MPa, a yield strength of 160-190 MPa and an elongation of less than 3%, which leads to a high tendency to deformation of the products. Therefore, it is difficult for this material to meet the strength requirements of products such as mobile phones and notebook computers in future.

As a result, related techniques of die casting aluminum alloys still need to be improved.

SUMMARY

An objective of the present disclosure is to at least resolve one of the technical problems in the related art to some extent. Therefore, an objective of the present disclosure is to provide a high-strength die casting aluminum alloy.

In one aspect of the present disclosure, the present disclosure provides an aluminum alloy. According to examples of the present disclosure, based on the total weight of the aluminum alloy, in percentage by weight, the aluminum alloy includes: 11-15% of Zn; 7.5-9% of Si; 1.2-2% of Cu; 0.3-0.5% of Mn; 0.05-0.3% of Mg; 0.1-0.2% of Ni; 0.001-0.04% of Sr; 0.05-0.3% of Ti; 0.01-0.15% of Fe; and 72.51-79.79% of Al. By controlling the composition and contents of alloying elements, the aluminum alloy has the advantages of high mechanical strength, good ductility and excellent castability, and is suitable for structural members requiring high strength, such as 3C product structural members and automotive load-bearing structural members.

In another aspect of the present disclosure, the present disclosure provides a method for preparing the aforementioned aluminum alloy. According to examples of the present disclosure, the method includes: melting aluminum, a zinc-containing raw material, a silicon-containing raw material, a copper-containing raw material, a manganese-containing raw material, a magnesium-containing raw material, a nickel-containing raw material, a strontium-containing raw material, a titanium-containing raw material and an iron-containing raw material by heating to obtain a molten aluminum alloy; and deslagging, refining and casting on the molten aluminum alloy to obtain an aluminum alloy ingot. The method is simple and convenient to operate, and easy for industrial implementation. The obtained aluminum alloy has the advantages of high mechanical strength, good ductility and excellent castability.

In another aspect of the present disclosure, the present disclosure provides an aluminum alloy structural member. According to examples of the present disclosure, at least a part of the aluminum alloy structural member comprises the aforementioned aluminum alloy. The aluminum alloy structural member has all the features and advantages of the aforementioned aluminum alloy, which will not be described in detail here.

DETAILED DESCRIPTION

Embodiments of the present disclosure will be described in detail below. The embodiments described below are exemplary and for explaining the present disclosure only, and are not intended to be construed as limiting the present disclosure. If the specific techniques or conditions are not indicated in the examples, the techniques or conditions described in the literature in the art or the product specification shall be followed. Those reagents or instruments whose manufacturers are not given are conventional products that are commercially available.

In one aspect of the present disclosure, the present disclosure provides an aluminum alloy. According to examples of the present disclosure, based on the total weight of the aluminum alloy, in percentage by weight, the aluminum alloy includes: 11-15% of Zn; 7.5-9% of Si; 1.2-2% of Cu; 0.3-0.5% of Mn; 0.05-0.3% of Mg; 0.1-0.2% of Ni; 0.001-0.04% of Sr; 0.05-0.3% of Ti; 0.01-0.15% of Fe; and 72.51-79.79% of Al. By controlling the composition and contents of alloying elements, the aluminum alloy has the advantages of high mechanical strength, good ductility and excellent castability, and is suitable for structural members requiring high strength, such as 3C product structural members and automotive load-bearing structural members.

In some embodiments, a content of the Zn element in the aluminum alloy may be 11%, 12%, 13%, 14%, 15% or the like. The Zn element may be dissolved in Al to form a solid solution, resulting in lattice distortion, thereby increasing the strength of aluminum alloy materials. If the content of Zn is too high, there is only a limited amount of Zn dissolved, the excess Zn will be separated out, which will reduce the plasticity of the alloy and increase the hot cracking tendency of the alloy. If the content of Zn is too low, the solid solution strengthening effect of Zn is not enough, which will reduce the strength of the alloy.

In some embodiments, a content of the Si element in the aluminum alloy may be 7.5%, 8%, 9% or the like. The Si element, as the principal mechanical strengthening element, is dissolved in Al to form an $\alpha$-Al solid solution and an Al—Si eutectic or hypoeutectic phase, which will enhance the mechanical properties of the material and ensure both the fluidity in die casting and the yield in mass production. If the content of Si is too high, the quantity of the Al—Si eutectic will be too large, which will reduce the plasticity of the alloy.

If the content of Si is too low, the quantity of the Al—Si eutectic will be too small, which will reduce the die castability of the alloy and lead to an incapability of mass production of the alloy.

In some embodiments, a content of the Cu element in the aluminum alloy may be 1.2%, 1.5%, 1.8%, 2% or the like. Cu exists in the aluminum alloy mainly in two forms: a part of Cu is dissolved in an aluminum matrix to have a solid solution strengthening effect; and in addition to the solid solution strengthening effect, when the Cu content is high enough, the excess Cu is separated out from the matrix to form a dispersed second phase $CuAl_2$, which will increase the hardness and strength of the aluminum alloy. If the content of Cu is too high, the fracture toughness and elongation will be reduced. If the content of Cu is too low, the strength of the alloy will be reduced. within the above content range, a good strengthening effect can be gained while the fracture toughness and elongation will not be reduced.

In some embodiments, a content of the Mn element in the aluminum alloy may be 0.3%, 0.4%, 0.5% or the like. Mn may make the aluminum alloy have better plasticity. If the content of Mn is too high, a large amount of hard brittle phase $MnAl_6$ phase will be formed, which will reduce the plasticity of the alloy and increase the hot cracking tendency of the alloy. If the content of Mn is too low, the die castability of the alloy will be reduced.

In some embodiments, a content of the Mg element in the aluminum alloy may be 0.05%, 0.1%, 0.2%, 0.3% or the like. The Mg element may have a strengthening effect on the alloy. With the increase of the content of Mg, the solid-liquid zone increases, and the fluidity decreases. However, with the further increase of the content of Mg, the alloying degree of the material increases and the fluidity increases accordingly, whereas the hot cracking tendency of the material increases, which leads to an increase in the possibility of cracking and other defects of the product during die casting. Therefore, if the content of Mg is too high, the die castability of the alloy will be reduced. If the content of Mg is too low, the strengthening effect of Mg on the alloy is limited, which will reduce the strength of the alloy.

In some embodiments, a content of the Sr element in the aluminum alloy may be 0.001%, 0.01%, 0.02%, 0.03%, 0.04% or the like. The addition of Sr as a modifier to the aluminum alloy may refine the α-Al solid solution and the acicular Si phase, improve the aluminum alloy structure, purify the grain boundary and reduce the resistance to movement of electrons in the alloy, thereby further enhancing the thermal conductivity and mechanical properties of the material. If the content of Sr is too high, the AlZn solid solution of the alloy will be coarse, and the eutectic silicon phase distributed around will start to grow significantly, which will reduce the plasticity and strength of the alloy. If the content of Sr is too low, the strengthening effect of Sr on the alloy is limited, which will reduce the strength of the alloy.

In some embodiments, a content of the Ni element in the aluminum alloy may be 0.1%, 0.15%, 0.2% or the like, and a content of the Ti element may be 0.05%, 0.1%, 0.2%, 0.3% or the like. The addition of Ni and Ti may refine the second phase and enhance the comprehensive properties of the aluminum alloy. If the contents of Ni and Ti are too high, the grains of the eutectic silicon phase will grow abnormally, which will reduce the plasticity and strength of the alloy. If the contents of Ni and Ti are too low, the strength of the alloy will be reduced.

In some embodiments, a content of the Fe element in the aluminum alloy may be 0.01%, 0.10%, 0.12%, 0.15% or the like. If the content of Fe is too high, the excess Fe will lead to the formation of the acicular or flaky Al—Si—Fe phase in the aluminum alloy, and the grains will be split, which will lead to a decrease in the toughness of the aluminum alloy and a fracture in the product. If the content of Fe is too low, the die sticking tendency of the alloy will increase, which will reduce the die castability of the alloy.

According to examples of the present disclosure, a weight ratio of Cu to Mg is 6:1-30:1 (such as 6:1, 8:1, 10:1, 12:1, 15:1, 18:1, 20:1, 22:1, 25:1, 28:1, 30:1, etc). In some examples, based on the total weight of the aluminum alloy, in percentage by weight, the aluminum alloy includes 11-12% (including the endpoints 11% and 12%) of Zn. The weight ratio of Cu to Mg is 6:1-10:1 (such as 6:1, 6.5:1, 7:1, 7.5:1, 8:1, 8.5:1, 9:1, 9.5:1, 10:1, etc.). A weight ratio of Ti to Ni is 0.9:1.1-1.1:0.9 (such as 0.9:1.1, 1:1, 1.1:0.9, etc.). Within the above content ranges, all the Cu can be dissolved in the aluminum matrix, Mg and Zn can form a large amount of $Al_2Mg_3Zn_3$ phase, which has a significant strengthening effect. A fine and uniform precipitation strengthening phase can be obtained by refining the $Al_2Mg_3Zn_3$ phase through the modification of a small amount of Ti. When a small amount of Ni is added and the ratio of Ni to Ti is (0.9-1.1):(0.9-1.1), hard AlNi particles can be formed, which promotes nucleation. Thus, the size of the aluminum matrix is refined significantly, the strength of the aluminum alloy is increased significantly, and the elongation is basically unchanged.

In some examples, based on the total weight of the aluminum alloy, in percentage by weight, the aluminum alloy includes 12-15% (including the endpoint 15% and excluding the endpoint 12%) of the Zn. A weight ratio of Cu to Mg is 12:1-24:1 (such as 12:1, 13:1, 14:1, 15:1, 16:1, 17:1, 18:1, 19:1, 20:1, 21:1, 22:1, 23:1, 24:1, etc.). A weight ratio of Ti to Ni is 1.9:1.1-2.1:0.9 (such as 1.9:1.1, 2:1, 2.1:1, 2.1:0.9, etc.). At this time, the content of Zn exceeds the critical value 12%, the solid solubility of Cu decreases sharply, a small amount of Cu is dissolved in the aluminum matrix, and most of Cu forms $CuAl_2$. Mg forms an $Al_2Mg_3Zn_3$ phase, and an $MgZn_2$ phase appears. The $MgZn_2$ phase is coarse and dendritic and will affect the elongation of the aluminum alloy, Ti may be added to refine the $MgZn_2$. When Ti is added in a proper ratio, $MgZn_2$ becomes fibrous, and a strengthening phase $Mg_2Ti$ appears. The remaining Ti can form hard AlNi particles with Ni, which promotes nucleation. Thus, the size of the aluminum matrix is refined significantly, and the strength of the material is increased.

In some examples, a sum of Fe and Mn in the aluminum alloy of the present disclosure is greater than or equal to 0.45%. In some examples, the sum of Fe and Mn in the aluminum alloy may be 0.45-0.6% (such as 0.45%, 0.5%, 0.55%, 0.6%, etc.). Within this range, the die can have good resistance to erosion of the aluminum alloy in the production process.

In some examples, a weight ratio of Fe to Mn may be 1:4-1:10. In some examples, the weight ratio of Fe to Mn may be 1:5-1:9, and further may be 1:5, 1:6, 1:7, 1:8, 1:9, etc. Within this range, all Fe forms $Al_6$ (Fe, Mn), and the acicular phase of Fe, which may lower the plasticity of the aluminum alloy, can be avoided.

According to examples of the present disclosure, the aluminum alloy further includes inevitable impurities. Based on the total weight of the aluminum alloy, in percentage by weight, a content of an individual element in the inevitable impurities is not greater than 0.01%, and a total content of the inevitable impurities is not greater than 0.1%. The purity of the raw materials can hardly reach 100% and impurities may be introduced during the preparation process, the aluminum alloy usually contains inevitable impurities (such as P, Cr, Zr, Sc, etc.). In the present disclosure, the content of the individual element in the impurity elements in the aluminum alloy may be 0.01%, 0.009%, 0.008t %, 0.007%, 0.006%, 0.005%, 0.004%, 0.003%, 0.002%, 0.001%, etc., and the total content of the impurity elements may specifically be 0.1%, 0.09%, 0.08%, 0.07%, 0.06%, 0.05%, 0.04%, 0.03%, 0.02%, 0.01%, etc. In some examples, the aluminum alloy containing three impurity elements Zr, Cr and P, the content of each of Zr, Cr and P is less than 0.01%, and the sum of contents of Zr, Cr and P is less than 0.1%. Thereby, the inevitable impurities within the above ranges can ensure that the aluminum alloy gains satisfactory properties without being negatively affected.

According to examples of the present disclosure, based on the total weight of the aluminum alloy, in percentage by weight, the aluminum alloy includes: 11-13% of Zn; 8-9% of Si; 1.2-1.5% of Cu; 0.4-0.5% of Mn; 0.05-0.2% of Mg; 0.1-0.15% of Ni; 0.001-0.04% of Sr; 0.1-0.25% of Ti; 0.05-0.1% of Fe; and 72.26-79.1% of Al.

In some examples, based on the total weight of the aluminum alloy, in percentage by weight, the aluminum alloy is composed of the following components: 11-15% of Zn; 7.5-9% of Si; 1.2-2% of Cu; 0.3-0.5% of Mn; 0.05-0.3% of Mg; 0.1-0.2% of Ni; 0.001-0.04% of Sr; 0.05-0.3% of Ti; 0.01-0.15% of Fe; and the balance of Al.

In some examples, based on the total weight of the aluminum alloy, in percentage by weight, the aluminum alloy is composed of the following components: 11-13% of Zn; 8-9% of Si; 1.2-1.5% of Cu; 0.4-0.5% of Mn; 0.05-0.2% of Mg; 0.1-0.15% of Ni; 0.001-0.04% of Sr; 0.1-0.25% of Ti; 0.05-0.1% of Fe; and the balance of Al.

The aluminum alloy with the components and the percentages thereof above has high strength, good plasticity, good die castability and good thermal conductivity, and is suitable for preparing 3C product structural members (for example, casings, middle frames and internal structural members of mobile phones) and automotive load-bearing structural members.

According to examples of the present disclosure, the aluminum alloy satisfies at least one of the following conditions: a yield strength is greater than or equal to 240 MPa, and may be 240-300 MPa (such as 240 MPa, 250 MPa, 260 MPa, 270 MPa, 280 MPa, 290 MPa, 300 MPa, etc.); a tensile strength is greater than or equal to 390 MPa, and may be 390-435 MPa (such as 390 MPa, 400 MPa, 410 MPa, 420 MPa, 430 MPa, 435 MPa, etc.); an elongation is greater than or equal to 4%, and may be 4-7.5% (such as 4%, 4.5%, 5%, 5.5%, 6%, 6.5%, 7%, 7.5%, etc.); a fluidity in die casting is greater than or equal to 1700 mm, and may be 1700-1800 mm (such as 1700 mm, 1710 mm, 1720 mm, 1730 mm, 1740 mm, 1750 mm, 1760 mm, 1770 mm, 1780 mm, 1790 mm, 1800 mm, etc.). In some examples, the aluminum alloy satisfies any one, any two, any three or all of the four conditions above. In some examples, the aluminum alloy may satisfy all of the four conditions above. Thereby, the aluminum alloy has good strength, die castability and plasticity at the same time, and can be effectively used in the manufacture of 3C product structural members and automotive load-bearing structural members.

In another aspect of the present disclosure, the present disclosure provides a method for preparing the aforementioned aluminum alloy. According to examples of the present disclosure, the method includes: melting aluminum, a zinc-containing raw material, a silicon-containing raw material, a copper-containing raw material, a manganese-containing raw material, a magnesium-containing raw material, a nickel-containing raw material, a strontium-containing raw material, a titanium-containing raw material and an iron-containing raw material by heating to obtain a molten aluminum alloy; and deslagging, refining and casting on the molten aluminum alloy to obtain an aluminum alloy ingot. The method is simple and convenient to operate, and easy for industrial implementation. The obtained aluminum alloy has the advantages of high mechanical strength, good ductility and excellent castability.

According to examples of the present disclosure, the method may includes: melting the aluminum and the silicon-containing raw material by heating, melting the copper-containing raw material, the manganese-containing raw material, the strontium-containing raw material, the nickel-containing raw material and the titanium-containing raw material by heating to obtain a first molten aluminum alloy; melting the zinc-containing raw material to the first molten aluminum alloy by heating to obtain a second molten aluminum alloy; melting the magnesium-containing raw material to the second molten aluminum alloy under an inert atmosphere by heating to obtain a third molten aluminum alloy; and deslagging, refining and casting on the third molten aluminum alloy to obtain the aluminum alloy ingot.

According to examples of the present disclosure, the above raw materials may be provided in a form that is not particularly limited and that can be flexibly selected according to actual demands. For example, aluminum may be provided in the form of an aluminum ingot, and the zinc-containing raw material, the silicon-containing raw material, the copper-containing raw material, the manganese-containing raw material, the magnesium-containing raw material, the nickel-containing raw material, the strontium-containing raw material, the titanium-containing raw material and the iron-containing raw material may be provided in the form of simple substances or master alloys. In some examples of the present disclosure, the method may include the following steps. A pure Al ingot and an Al—Si master alloy are put into a melting furnace and completely melted by heating while the melt is stirred every 2-3 minutes (for about 3-5 times). Then, an Al—Cu master alloy, an Al—Mn master alloy, an Al—Sr master alloy, an Al—Ni master alloy and an Al—Ti master alloy are sequentially added and immersed in the melt until they are melted. Finally, a pure Zn ingot is added. After the pure Zn ingot is melted, a pure magnesium ingot is added under an inert atmosphere (for example, a nitrogen atmosphere). After the pure magnesium ingot is melted, the melt is stirred to make the components uniform. Then, the content of each of the elements is detected and then adjusted to be within the required range. 0.5 wt % of slag remover is added for slag removal, and 0.5 wt % of refining agent is added for refining and degassing. Then, the melt is subjected to slagging-off, allowed to stand for 10-15 minutes, cooled to 700° C. or so, and cast into an ingot. The method is simple and convenient to operate, and easy for industrial implementation. The obtained aluminum alloy has the advantages of high strength, good mechanical properties and good die castability.

According to examples of the present disclosure, the method may further include: die casting on the aluminum alloy ingot, so that the aluminum alloy can be processed into various complex shapes to satisfy the operating requirements of different environments. The die casting satisfies at least one of the following conditions: a die temperature is 200-300° C. (such as 200° C., 220° C., 250° C., 280° C., 300° C., etc.); a feed temperature is 670-720° C. (such as 670° C., 680° C., 690° C., 700° C., 710° C., 720° C., etc.); an injection speed is 1.9-2.3 m/s (such as 1.9 m/s, 2.0 m/s, 2.1 m/s, 2.2 m/s, 2.3 m/s, etc.). The die casting under such conditions is more conducive to the forming of the aluminum alloy.

In another aspect of the present disclosure, the present disclosure provides an aluminum alloy structural member. According to examples of the present disclosure, at least a part of the aluminum alloy structural member comprises the aforementioned aluminum alloy. The aluminum alloy structural member has the advantages of high mechanical strength, good ductility and excellent castability, and is suitable for structural members requiring high strength, such as 3C product structural members and automotive load-bearing structural members. The aluminum alloy structural member may be formed by a simple die casting process. The aluminum alloy structural member has the advantages of good performance and low preparation cost. The aluminum alloy structural member with a small thickness still has good performance.

According to examples of the present disclosure, the aluminum alloy structural member includes at least one of a 3C product structural member and automotive load-bearing structural member, which specifically may be a middle frame, a back cover or a middle plate of a mobile phone. Thereby, the structural member has good mechanical strength, plasticity and die castability, and can well satisfy user's requirements for high strength of the product and improve the user experience.

The examples of the present disclosure will be described in detail below.

Example 1

In accordance with the formula in Table 1, an aluminum alloy die casting was obtained according to the following smelting steps and die casting parameters.

A pure Al ingot and an Al—Si master alloy were put into a melting furnace and completely melted by heating while the melt was stirred every 2-3 minutes (for about 3-5 times). Then, an Al—Cu master alloy, an Al—Mn master alloy, an Al—Sr master alloy, an Al—Ni master alloy and an Al—Ti master alloy were sequentially added and immersed in the melt until they were melted. Finally, a pure Zn ingot was added. After the pure Zn ingot was melted, a pure magnesium ingot was added under a nitrogen atmosphere. After the pure magnesium ingot was melted, the melt was stirred to make the components uniform. Then, the content of each of the elements was detected and then adjusted to be within the required range. 0.5 wt % of slag remover was added for slag removal, and 0.5 wt % of refining agent was added for refining and degassing. Then, the melt was subjected to slagging-off, allowed to stand for 10-15 minutes, cooled to 700° C. or so, and cast into an ingot. After the cast ingot was cooled, die casting was carried out. The parameters of the die casting may be: a die temperature of 200-300° C., a feed temperature of 670-720° C., and an injection speed of 1.9-2.3 m/s.

Examples 2-33

In accordance with the formulae in Table 1, aluminum alloy die castings were obtained according to the method in Example 1.

Comparative Examples 1-17

In accordance with the formulae in Table 1, aluminum alloy die castings were obtained according to the method in Example 1.

TABLE 1

(unit: wt %)

| | Zn | Si | Cu | Mg | Mn | Ni | Sr | Ti | Fe | Inevitable impurities and balance of aluminum |
|---|---|---|---|---|---|---|---|---|---|---|
| Example 1 | 12 | 8.5 | 1.5 | 0.15 | 0.5 | 0.1 | 0.04 | 0.1 | 0.1 | 77.01 |
| Example 2 | 12.5 | 8.5 | 1.5 | 0.15 | 0.5 | 0.1 | 0.04 | 0.1 | 0.1 | 76.51 |
| Example 3 | 15 | 8.5 | 1.5 | 0.15 | 0.5 | 0.1 | 0.04 | 0.1 | 0.1 | 74.01 |
| Example 4 | 11 | 8.5 | 1.5 | 0.15 | 0.5 | 0.1 | 0.04 | 0.1 | 0.1 | 78.01 |
| Example 5 | 12 | 7.5 | 1.5 | 0.15 | 0.5 | 0.1 | 0.04 | 0.1 | 0.1 | 78.01 |
| Example 6 | 12 | 8 | 1.5 | 0.15 | 0.5 | 0.1 | 0.04 | 0.1 | 0.1 | 77.51 |
| Example 7 | 12 | 9 | 1.5 | 0.15 | 0.5 | 0.1 | 0.04 | 0.1 | 0.1 | 76.51 |
| Example 8 | 12 | 8.5 | 1.2 | 0.15 | 0.5 | 0.1 | 0.04 | 0.1 | 0.1 | 77.31 |
| Example 9 | 12 | 8.5 | 2 | 0.15 | 0.5 | 0.1 | 0.04 | 0.1 | 0.1 | 76.51 |
| Example 10 | 12 | 8.5 | 1.5 | 0.05 | 0.5 | 0.1 | 0.04 | 0.1 | 0.1 | 77.11 |
| Example 11 | 12 | 8.5 | 1.5 | 0.10 | 0.5 | 0.1 | 0.04 | 0.1 | 0.1 | 77.06 |
| Example 12 | 12 | 8.5 | 1.5 | 0.2 | 0.5 | 0.1 | 0.04 | 0.1 | 0.1 | 76.96 |
| Example 13 | 12 | 8.5 | 1.5 | 0.25 | 0.5 | 0.1 | 0.04 | 0.1 | 0.1 | 76.91 |
| Example 14 | 12 | 8.5 | 1.5 | 0.3 | 0.5 | 0.1 | 0.04 | 0.1 | 0.1 | 76.86 |
| Example 15 | 12 | 8.5 | 1.5 | 0.15 | 0.3 | 0.1 | 0.04 | 0.1 | 0.1 | 77.21 |
| Example 16 | 12 | 8.5 | 1.5 | 0.15 | 0.4 | 0.1 | 0.04 | 0.1 | 0.1 | 77.11 |
| Example 17 | 12 | 8.5 | 1.5 | 0.15 | 0.5 | 0.15 | 0.04 | 0.1 | 0.1 | 76.96 |
| Example 18 | 12 | 8.5 | 1.5 | 0.15 | 0.5 | 0.2 | 0.04 | 0.1 | 0.1 | 76.91 |
| Example 19 | 12 | 8.5 | 1.5 | 0.15 | 0.5 | 0.1 | 0.001 | 0.1 | 0.1 | 77.049 |
| Example 20 | 12 | 8.5 | 1.5 | 0.15 | 0.5 | 0.1 | 0.02 | 0.1 | 0.1 | 77.03 |
| Example 21 | 12 | 8.5 | 1.5 | 0.15 | 0.5 | 0.1 | 0.04 | 0.05 | 0.1 | 77.06 |
| Example 22 | 12 | 8.5 | 1.5 | 0.15 | 0.5 | 0.1 | 0.04 | 0.2 | 0.1 | 76.91 |
| Example 23 | 12 | 8.5 | 1.5 | 0.15 | 0.5 | 0.1 | 0.04 | 0.3 | 0.1 | 76.81 |
| Example 24 | 12 | 8.5 | 1.5 | 0.15 | 0.5 | 0.1 | 0.04 | 0.1 | 0.01 | 77.1 |
| Example 25 | 12 | 8.5 | 1.5 | 0.15 | 0.5 | 0.1 | 0.04 | 0.1 | 0.05 | 77.06 |
| Example 26 | 12 | 8.5 | 1.5 | 0.15 | 0.5 | 0.1 | 0.04 | 0.1 | 0.15 | 76.96 |

TABLE 1-continued (unit: wt %)

| | Zn | Si | Cu | Mg | Mn | Ni | Sr | Ti | Fe | Inevitable impurities and balance of aluminum |
|---|---|---|---|---|---|---|---|---|---|---|
| Example 27 | 15 | 8.5 | 1.2 | 0.1 | 0.4 | 0.1 | 0.04 | 0.2 | 0.1 | 74.36 |
| Example 28 | 15 | 8.5 | 1.2 | 0.1 | 0.4 | 0.1 | 0.04 | 0.19 | 0.05 | 74.42 |
| Example 29 | 13 | 8.5 | 1.2 | 0.1 | 0.4 | 0.1 | 0.04 | 0.21 | 0.05 | 76.4 |
| Example 30 | 13 | 8.5 | 1.2 | 0.1 | 0.3 | 0.1 | 0.04 | 0.23 | 0.05 | 76.48 |
| Example 31 | 11 | 8 | 1.5 | 0.1 | 0.5 | 0.1 | 0.04 | 0.1 | 0.1 | 78.56 |
| Example 32 | 13 | 7.5 | 1.5 | 0.1 | 0.5 | 0.1 | 0.04 | 0.1 | 0.1 | 77.06 |
| Example 33 | 13 | 7.5 | 1.5 | 0.2 | 0.5 | 0.1 | 0.04 | 0.3 | 0.1 | 76.76 |
| Comparative Example 1 | 10 | 8.5 | 1.5 | 0.1 | 0.5 | 0.1 | 0.04 | 0.1 | 0.1 | 79.06 |
| Comparative Example 2 | 17 | 8.5 | 1.5 | 0.1 | 0.5 | 0.1 | 0.04 | 0.1 | 0.1 | 72.06 |
| Comparative Example 3 | 12 | 7 | 1.5 | 0.1 | 0.5 | 0.1 | 0.04 | 0.1 | 0.1 | 78.56 |
| Comparative Example 4 | 12 | 10 | 1.5 | 0.1 | 0.5 | 0.1 | 0.04 | 0.1 | 0.1 | 75.56 |
| Comparative Example 5 | 12 | 8.5 | 1 | 0.1 | 0.5 | 0.1 | 0.04 | 0.1 | 0.1 | 77.56 |
| Comparative Example 6 | 12 | 8.5 | 2.8 | 0.1 | 0.5 | 0.1 | 0.04 | 0.1 | 0.1 | 75.76 |
| Comparative Example 7 | 12 | 8.5 | 1.5 | 0.4 | 0.5 | 0.1 | 0.04 | 0.1 | 0.1 | 76.76 |
| Comparative Example 8 | 12 | 8.5 | 1.5 | 0.01 | 0.5 | 0.1 | 0.04 | 0.1 | 0.1 | 77.15 |
| Comparative Example 9 | 12 | 8.5 | 1.5 | 0.1 | 0.1 | 0.1 | 0.04 | 0.1 | 0.1 | 77.46 |
| Comparative Example 10 | 12 | 8.5 | 1.5 | 0.1 | 0.7 | 0.1 | 0.04 | 0.1 | 0.1 | 76.86 |
| Comparative Example 11 | 12 | 8.5 | 1.5 | 0.1 | 0.5 | 0.05 | 0.04 | 0.1 | 0.1 | 77.11 |
| Comparative Example 12 | 12 | 8.5 | 1.5 | 0.1 | 0.5 | 0.25 | 0.04 | 0.1 | 0.1 | 76.91 |
| Comparative Example 13 | 12 | 8.5 | 1.5 | 0.1 | 0.5 | 0.1 | 0.1 | 0.1 | 0.1 | 77 |
| Comparative Example 14 | 12 | 8.5 | 1.5 | 0.1 | 0.5 | 0.1 | 0.04 | 0.01 | 0.1 | 77.15 |
| Comparative Example 15 | 12 | 8.5 | 1.5 | 0.1 | 0.5 | 0.1 | 0.04 | 0.3 | 0.1 | 76.86 |
| Comparative Example 16 | 12 | 8.5 | 1.5 | 0.1 | 0.5 | 0.1 | 0.04 | 0.1 | 0.001 | 77.159 |
| Comparative Example 17 | 12 | 8.5 | 1.5 | 0.1 | 0.5 | 0.1 | 0.04 | 0.1 | 0.5 | 76.66 |

Performance Tests:

1. Mechanical Properties Testing

This test was used for determining the mechanical properties of the aluminum alloys obtained in the examples and comparative examples above after natural aging for 10 days at room temperature. The tensile strength, yield strength and elongation were tested according to "GB/T 228.1-2010 Metallic Materials-Tensile Testing-Part 1: Method of test at room temperature". The results are shown in Table 2.

2. Testing of Fluidity in Die Casting

This test was used for determining the fluidity of the aluminum alloys obtained in the examples and comparative examples above. Under the conditions of a die temperature of 200-300° C., a feed temperature of 670-720° C. and an injection speed of 1.9-2.3 m/s, die casting was carried out with a die for mosquito coils under atmospheric pressure. The fluidity in die casting of the obtained samples was evaluated based on the length of the samples. The larger the length, the better the fluidity. Generally, it is feasible to form a thin-walled member by die casting only when the fluidity is greater than 95% of the fluidity of ADC12 (the most common commercial die casting aluminum alloy ADC12 has a fluidity of 1750). The results are shown in Table 2.

TABLE 2

| | Yield strength (MPa) | Tensile strength (MPa) | Elongation (%) | Fluidity in die casting (mm) |
|---|---|---|---|---|
| Example 1 | 260 | 420 | 6.5 | 1790 |
| Example 2 | 270 | 410 | 6 | 1750 |
| Example 3 | 300 | 426 | 4.5 | 1760 |
| Example 4 | 255 | 427 | 6.5 | 1780 |
| Example 5 | 257 | 418 | 6.5 | 1740 |
| Example 6 | 255 | 419 | 6.5 | 1770 |
| Example 7 | 275 | 405 | 5.5 | 1790 |
| Example 8 | 250 | 415 | 6.5 | 1770 |
| Example 9 | 290 | 425 | 4.5 | 1740 |
| Example 10 | 240 | 425 | 7.5 | 1780 |
| Example 11 | 255 | 412 | 6 | 1750 |
| Example 12 | 285 | 418 | 4.5 | 1730 |
| Example 13 | 287 | 420 | 4 | 1730 |
| Example 14 | 280 | 420 | 4 | 1740 |
| Example 15 | 255 | 431 | 6 | 1710 |
| Example 16 | 260 | 415 | 6.5 | 1750 |
| Example 17 | 258 | 421 | 6 | 1750 |
| Example 18 | 275 | 418 | 6 | 1760 |
| Example 19 | 245 | 408 | 5.5 | 1780 |
| Example 20 | 251 | 412 | 6 | 1770 |
| Example 21 | 252 | 421 | 6.5 | 1750 |
| Example 22 | 265 | 415 | 6 | 1780 |

TABLE 2-continued

| | Yield strength (MPa) | Tensile strength (MPa) | Elongation (%) | Fluidity in die casting (mm) |
|---|---|---|---|---|
| Example 23 | 250 | 420 | 5.5 | 1750 |
| Example 24 | 253 | 415 | 6 | 1710 |
| Example 25 | 275 | 414 | 6.5 | 1720 |
| Example 26 | 255 | 410 | 6 | 1760 |
| Example 27 | 260 | 412 | 6 | 1750 |
| Example 28 | 265 | 420 | 6.5 | 1720 |
| Example 29 | 285 | 425 | 7 | 1790 |
| Example 30 | 280 | 430 | 7 | 1780 |
| Example 31 | 250 | 415 | 5.5 | 1770 |
| Example 32 | 265 | 400 | 5 | 1770 |
| Example 33 | 260 | 400 | 4.5 | 1760 |
| Comparative Example 1 | 230 | 380 | 4 | 1720 |
| Comparative Example 2 | 270 | 400 | 1.5 | 1590 |
| Comparative Example 3 | 250 | 390 | 4 | 1550 |
| Comparative Example 4 | 230 | 365 | 2.1 | 1780 |
| Comparative Example 5 | 237 | 350 | 3.5 | 1650 |
| Comparative Example 6 | 295 | 382 | 1..6 | 1620 |
| Comparative Example 7 | 280 | 370 | 1.1 | 1400 |
| Comparative Example 8 | 230 | 405 | 5.5 | 1550 |
| Comparative Example 9 | 245 | 225 | 6 | 1550 |
| Comparative Example 10 | 255 | 385 | 3.5 | 1720 |
| Comparative Example 11 | 242 | 398 | 5.5 | 1650 |
| Comparative Example 12 | 275 | 385 | 2.7 | 1540 |
| Comparative Example 13 | 257 | 375 | 5.5 | 1620 |
| Comparative Example 14 | 230 | 405 | 4.5 | 1760 |
| Comparative Example 15 | 260 | 378 | 3.5 | 1750 |
| Comparative Example 16 | 250 | 419 | 6 | 1520 |
| Comparative Example 17 | 263 | 365 | 3.5 | 1780 |

By comparing the results of the examples and comparative examples above, it can be seen that on the premise that the ductility and castability (fluidity) of the aluminum alloy of the present disclosure are ensured, the aluminum alloy has a greatly improved mechanical strength (preferably yield strength), and also has good resistance to erosion, hot cracking and die sticking. As can be seen from Comparative Examples 1-17, if the contents of the components are not within the range of the present disclosure, the aluminum alloy will not have good mechanical properties (yield strength and tensile strength), elongation, fluidity and resistances to erosion, hot cracking and die sticking at the same time. Either all of the properties above are poor, or one or two of the properties above are good, but the other properties are poor, so the aluminum alloy fails to reach an equilibrium between mechanical properties, elongation and fluidity. Based on the above, by adjusting the components and the percentages thereof in the aluminum alloy to make them cooperate and synergize with each other, the aluminum alloy of the present disclosure has good mechanical properties, elongation and fluidity at the same time, and is suitable for structural members requiring high strength.

In the description of this specification, the description of the reference terms such as "an embodiment", "some embodiments", "exemplary embodiments", "example", "specific example", or "some examples" means that the specific features, structures, materials or characteristics described with reference to the embodiment or example are included in at least one embodiment or example of the present disclosure. In this specification, exemplary descriptions of the foregoing terms do not necessarily refer to a same embodiment or example. Moreover, the specific features, structures, materials, or characteristics described may be combined in any one or more embodiments or examples in a suitable manner. In addition, different embodiments or examples described in this specification, as well as features of different embodiments or examples, may be integrated and combined by those skilled in the art without contradicting each other.

Although the embodiments of the present disclosure have been shown and described above, it is to be understood that the foregoing embodiments are exemplary and are not intended to be construed as limiting the present disclosure, and changes, modifications, substitutions, and variations of the foregoing embodiments may be made by those of ordinary skill in the art without departing from the scope of the present disclosure.

What is claimed is:

1. An aluminum alloy, wherein based on a total weight of the aluminum alloy, in percentage by weight, the aluminum alloy comprises:

11-15% of Zn;
7.5-9% of Si;
1.2-2% of Cu;
0.3-0.5% of Mn;
0.05-0.3% of Mg;
0.1-0.2% of Ni;
0.001-0.04% of Sr;
0.05-0.3% of Ti;
0.01-0.15% of Fe; and
72.51-79.79% of Al, wherein the aluminum alloy has a yield strength greater than or equal to 240 MPa, a tensile strength greater than or equal to 390 MPa, an elongation greater than or equal to 4%, and a fluidity in die casting greater than or equal to 1700 mm.

2. The aluminum alloy according to claim 1, wherein based on the total weight of the aluminum alloy, in percentage by weight, the aluminum alloy comprises:

11-13% of Zn;
8-9% of Si;
1.2-1.5% of Cu;
0.4-0.5% of Mn;
0.05-0.2% of Mg;
0.1-0.15% of Ni;
0.001-0.04% of Sr;
0.1-0.25% of Ti;
0.05-0.1% of Fe; and
72.26-79.1% of Al.

3. The aluminum alloy according to claim 2, wherein a weight ratio of Cu to Mg is 6:1-30:1.

4. The aluminum alloy according to claim 3, wherein based on the total weight of the aluminum alloy, in percentage by weight, the aluminum alloy comprises 11-12% of Zn, a weight ratio of Cu to Mg is 6:1-10:1, and a weight ratio of Ti to Ni is 0.9:1.1-1.1:0.9.

5. The aluminum alloy according to claim 4, wherein based on the total weight of the aluminum alloy, in percentage by weight, the aluminum alloy comprises 12-15% of Zn, a weight ratio of Cu to Mg is 12:1-24:1, and a weight ratio of Ti to Ni is 1.9:1.1-2.1:0.9.

6. The aluminum alloy according to claim 1, wherein a weight ratio of Cu to Mg is 6:1-30:1.

7. The aluminum alloy according to claim 1, wherein based on the total weight of the aluminum alloy, in percentage by weight, the aluminum alloy comprises 11-12% of Zn, a weight ratio of Cu to Mg is 6:1-10:1, and a weight ratio of Ti to Ni is 0.9:1.1-1.1:0.9.

8. The aluminum alloy according to claim 1, wherein based on the total weight of the aluminum alloy, in percentage by weight, the aluminum alloy comprises 12-15% of Zn, a weight ratio of Cu to Mg is 12:1-24:1, and a weight ratio of Ti to Ni is 1.9:1.1-2.1:0.9.

9. The aluminum alloy according to claim 1, satisfying at least one of the following conditions:

a sum of Fe and Mn is greater than or equal to 0.45%; or a weight ratio of Fe to Mn is 1:4-1:10.

10. The aluminum alloy according to claim 1, satisfying at least one of the following conditions:

a sum of Fe and Mn is 0.45-0.6%; or a weight ratio of Fe to Mn is 1:5-1:9.

11. The aluminum alloy according to claim 1, further comprising inevitable impurities, wherein based on the total weight of the aluminum alloy, in percentage by weight, a content of an individual element in the inevitable impurities is less than or equal to 0.01%, and a total content of the inevitable impurities is less than or equal to 0.1%.

12. The aluminum alloy according to claim 1, satisfying at least one of the following conditions:

a yield strength is greater than or equal to 240 MPa;

a tensile strength is greater than or equal to 390 MPa;

an elongation is greater than or equal to 4%; or a fluidity in die casting is greater than or equal to 1700 mm.

13. The aluminum alloy according to claim 1, satisfying at least one of the following conditions:

the yield strength is 240-300 MPa;

the tensile strength is 390-435 MPa;

the elongation is 4-7.5%; or the fluidity in die casting is 1700-1800 mm.

14. A method for preparing the aluminum alloy according to claim 1, comprising:

melting aluminum, a zinc-containing raw material, a silicon-containing raw material, a copper-containing raw material, a manganese-containing raw material, a magnesium-containing raw material, a nickel-containing raw material, a strontium-containing raw material, a titanium- containing raw material and an iron-containing raw material by heating to obtain a molten aluminum alloy; and deslagging, refining and casting on the molten aluminum alloy to obtain an aluminum alloy ingot.

15. The method according to claim 14, comprising:

melting the aluminum and the silicon-containing raw material by heating to obtain a mixture, melting the copper-containing raw material, the manganese-containing raw material, the strontium-containing raw material, the nickel-containing raw material and the titanium-containing raw material to the mixture by heating to obtain a first molten aluminum alloy;

melting the zinc-containing raw material to the first molten aluminum alloy by heating to obtain a second molten aluminum alloy;

melting the magnesium-containing raw material to the second molten aluminum alloy under an inert atmosphere by heating to obtain a third molten aluminum alloy; and deslagging, refining and casting on the third molten aluminum alloy to obtain the aluminum alloy ingot.

16. The method according to claim 14, further comprising: die casting on the aluminum alloy ingot; wherein the die casting satisfies at least one of the following conditions:

a die temperature is 200-300° C.;

a feed temperature is 670-720° C.; or an injection speed is 1.9-2.3 m/s.

17. An aluminum alloy structural member, wherein at least a part of the aluminum alloy structural member comprises the aluminum alloy according to claim 1.

18. The aluminum alloy structural member according to claim 17, wherein the aluminum alloy structural member comprises at least one of computer structural member, communication structural member, consumer electronic structural member or automotive load-bearing structural member.

19. An electronic device, comprising the aluminum alloy according to claim 1.

20. An automotive load-bearing structural member, comprising the aluminum alloy according to claim 1.

* * * * *